United States Patent [19]

Hugunin

[11] Patent Number: 4,889,342

[45] Date of Patent: Dec. 26, 1989

[54] ALL-WEATHER GOLF DRIVING RANGE

[76] Inventor: Harvey W. Hugunin, 302 Hurlburt Rd., Syracuse, N.Y. 13224

[21] Appl. No.: 224,385

[22] Filed: Jul. 26, 1988

[51] Int. Cl.[4] ..... A63B 69/36; F24F 9/00; F24F 13/00

[52] U.S. Cl. ..... 273/176 R; 273/35 B; 273/195 R; 98/40.01; 98/39.1; 98/36

[58] Field of Search ..... 273/35 R, 35 B, 176 R, 273/176 A–176 L, 32 R, 195 R; 98/31.6, 33.1, 36, 39.1, 40.01, 40.1; 237/46; 15/215–217, 238; 55/DIG. 29

[56] References Cited

U.S. PATENT DOCUMENTS

| | | | |
|---|---|---|---|
| 3,860,236 | 1/1975 | Buchanan | 273/35 B |
| 4,531,454 | 7/1985 | Spoormaker | 98/31.6 |
| 4,598,631 | 7/1986 | Everett | 98/33.1 |

*Primary Examiner*—Edward M. Coven
*Assistant Examiner*—S. Passaniti
*Attorney, Agent, or Firm*—Charles S. McGuire

[57] ABSTRACT

A golf driving range of the single-user, stall-type especially constructed for driving golf balls in adverse weather conditions. A housing including a flooring, roof, side walls, back wall, and front wall with an open area is provided forming an enclosure from which balls are driven. A heating element is positioned behind the back wall upon a legged platform and communicates with an elongated duct section extending under the raised flooring of the housing. The duct section includes a duct fan which directs warmed air into two bin-type sections forming a plenum. An open grating is positioned in a front portion of the flooring adjacent the front wall and above the plenum such that warmed air rises from the plenum through the grating thereby heating the housing and the golfer.

5 Claims, 4 Drawing Sheets

ALL-WEATHER GOLF DRIVING RANGE

REFERENCE TO RELATED DISCLOSURE DOCUMENTS

The following application is based, in whole or in part, on the following Disclosure Documents:

No. 181904, dated Nov. 30, 1987;
No. 176999, dated Sept. 8, 1987;
No. 178834, dated Oct. 2, 1987; and
No. 172489, dated Nov. 25, 1987.

BACKGROUND OF THE INVENTION

This invention relates to golf driving ranges and, more particularly, to an improved stall-type enclosure for use at a golf driving range, or the like, and which is especially suited for driving golf balls in adverse weather conditions.

Heretofore, there has emerged golf driving ranges having enclosures which accommodate the golfer during inclement weather conditions. Typically, a housing of the individual stall-type is employed, including temperature stabilization means to keep the golfer comfortable. For example, U.S. Pat. No. 3,860,236, issued to Buchanan, discloses a stall-type heated housing unit with automated front door means which employs an air curtain as its heating method. U.S. Pat. No. 3,861,680, issued to Mowrer, discloses another stall-type heated housing unit which includes a ¾ length viewing window to retain a comfortable temperature with heating means positioned above the golfer. In both circumstances, either the trajectory of the driven ball is affected by the direct air current through which it must pass, or the full viewing area of the golfer is compromised by an obstructing veil.

It is therefore an object of the present invention to provide a temperature controlled housing unit for driving golf balls in all types of weather which maintains an essentially unobstructed pathway through which the ball is driven.

Another object is to provide a maximum viewing span for the golfer while driving the ball from a stall-type housing.

Still another object is to provide improved means of heating a stall-type housing unit for a golf driving range, while at the same time providing a better surface from which the golfer drives the ball.

Other objects will in part be obvious and in part appear hereinafter.

SUMMARY OF THE INVENTION

In accordance with the foregoing objects, the invention contemplates an all-weather golf driving range comprising one or more housing units of the single-user, stall-type which include a floor, roof, back and side walls having an open front through which a golfer may drive the ball by executing a full swing of the golf club. The open front preferably includes movable doors, allowing the housing to be closed when not in use.

The heating means include a heating element positioned behind the back wall of the housing in combination with an elongated duct, and duct fans which force warmed air into a plenum positioned beneath the floor of the housing from which the warmed air rises.

The portion of the floor of the housing upon which the golfer stands comprises an open grating positioned over the plenum such that the warmed air rises up through the grating to warm the housing and the golfer.

A resilient mat is placed upon a central portion of the grating to provide a surface upon which the ball is placed. One or more additional, rigid layer(s) of wood and/or metal are preferably placed between the resilient mat and the grating. The golfer stands on the mat and the warm air rises through the grating substantially around the perimeter of the mat.

DETAILED DESCRIPTION

Figure 1:
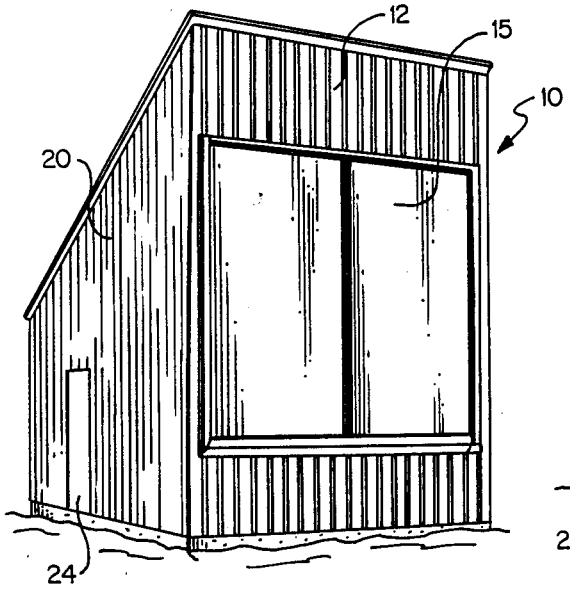
FIG. 1 is a front perspective view of the preferred embodiment of the housing unit, shown with doors closing the opening through which the balls are driven.
Figure 2:
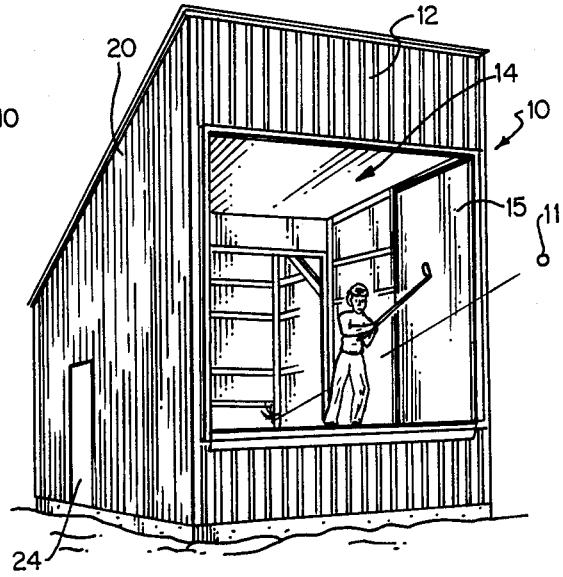
FIG. 2 is the same view as FIG. 1, showing the doors in the open position and a golfer driving a ball in the open position and a golfer driving a ball through the front opening.
Figure 3:
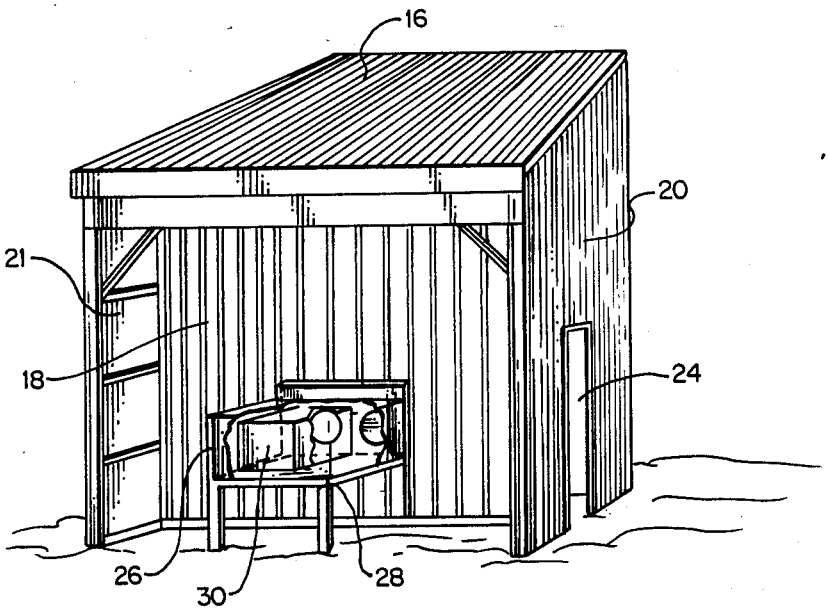
FIG. 3 is a perspective view showing the back wall of the housing including the heating element.

Referring now to the drawing, in FIGS. 1–3 is shown a housing unit of the single-user, stall-type for driving golf balls in various weather conditions. As can be seen in FIGS. 1 and 2, the housing unit, indicated generally by reference numeral 10, includes a front wall 12 with an opening 14 which may be closed by sliding or hinged doors 15, for example, when not in use, as shown in FIG. 1. FIG. 2 shows the front opening 14 with doors 15 open and a golfer executing a full swing of his golf club to drive the ball 11 therefrom. While the detailed description of the invention is of but one single housing unit, it should be understood that a plurality of such units would normally be arranged in side-by-side relation in a commercial driving range. Furthermore, one such unit may be constructed on a flat bed trailer, or the like, rendering the unit mobile. It should also be emphasized that the housing disclosed is not limited to the purpose of driving golf balls in inclement weather, but may provide the same comfortable atmosphere for any of a variety of sports in which a trajectory path is needed such as archery, skeet shooting and the like. Therefore, the term golf driving range, as used herein, should be taken as illustrative and not in a limiting sense.

In FIG. 3, the housing unit 10 is seen to include a roof 16, back wall 18, and two side walls 20 and 21. Wall 20 includes a door 24 for passage of the golfer into and out of the housing 10. The roof 16 and the side walls 20 and 21 extend rearwardly past the back wall 18 such that they substantially protect the heater housing 26 and enclosed heater 30 from the weather elements while providing easy access for servicing or replacement of heater 30. The heater housing 26 is supported above ground level by a legged platform 28.

Figure 4:
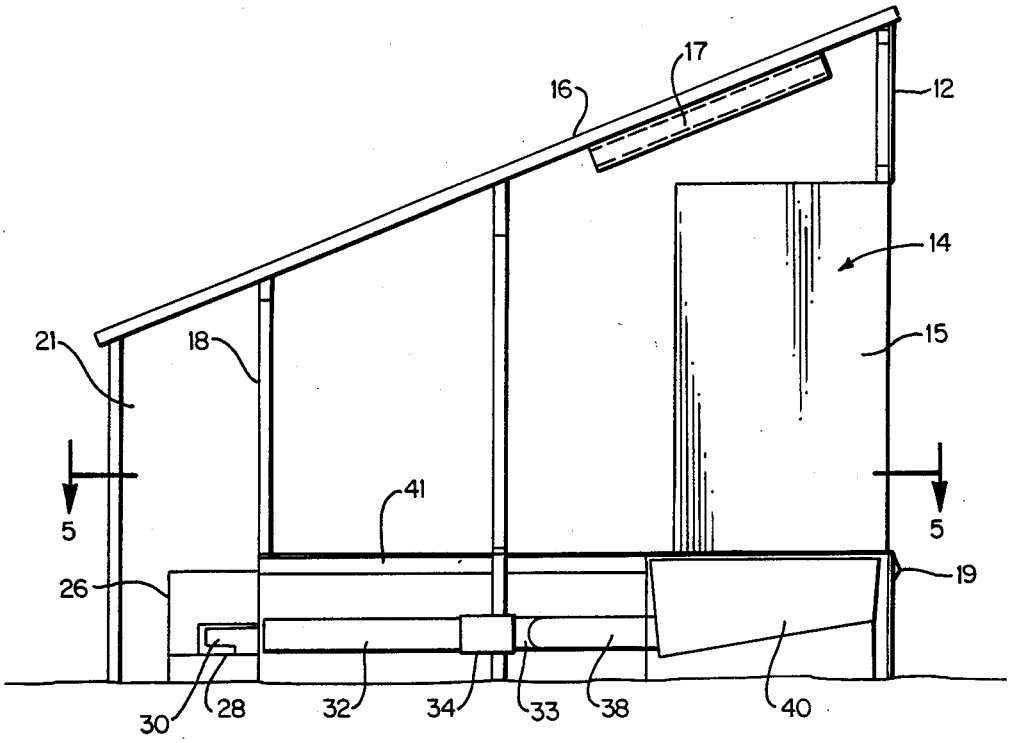
FIG. 4 is a side elevational view, shown in section.
Figure 5:
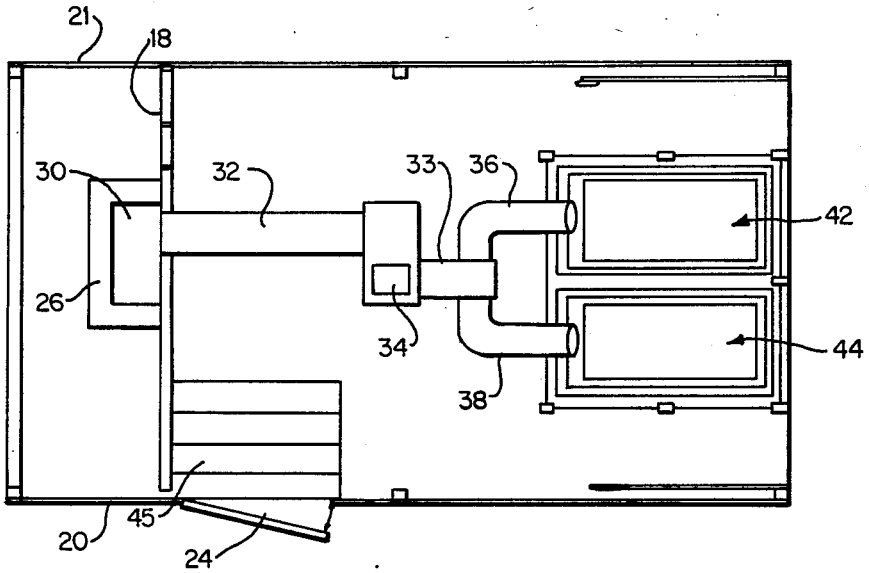
FIG. 5 is a top plan view, shown in section, taken on the line 5—5 of FIG. 4, including a somewhat diagrammatic showing of the heating apparatus of the invention.

The section view of FIG. 4 and top plan view of FIG. 5 shows the heating apparatus of the housing 10. Beginning from the rear of the housing, aforementioned heater housing 26 encloses a heater 30 which connects through an opening in rear wall 18 to an elongated linear duct section 32 and connecting to a duct fan 34. Duct fan 34 is preferably of the centrifugal type and is therefore laterally offset from the axis of the duct section 32, shown best in FIG. 5. In the preferred embodiment of the invention, duct fan 34 directs air from duct section 32 through duct section 33 which divides into two sections 36 and 38, communicating with two bin-type sections 42 and 44, respectively, providing a plenum for the improved distribution of warmed air. It is contemplated that the heating apparatus may be substituted with like air-conditioning apparatus for hot weather use.

Figure 7:
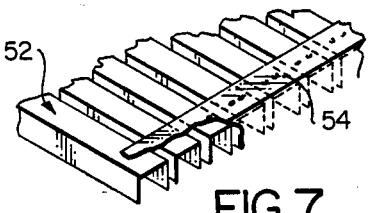
FIG. 7 is an enlarged, fragmentary, perpective view of a preferred form of the grating of FIG. 6.

The floor of the housing 10, indicated by reference numeral 41 in FIG. 4, is positioned above ground level, providing space for the heating apparatus just described. Also, as seen in FIG. 5, stairs 45 are provided between ground level and floor 41. The flooring directly above the sections 42 and 44 is in the form of an open grating covering the open area of the bins 42 and 44, and indicated by reference numeral 50 in FIG. 6. The forced warmed air rises from the bins 42 and 44 and through grating 50 into the housing 10. The grating 50 is preferably galvanized steel and further treated such that the upper surface is essentially slip-free. It is preferred that the grating 50 comprise a plurality of parallel, spaced, elongated, channel members 52 whose ends are attached by a riveted steel strip 54, as shown in FIG. 7. The spacing of the channel members allows the warmed air to rise therethrough and into the housing.

Figure 6:
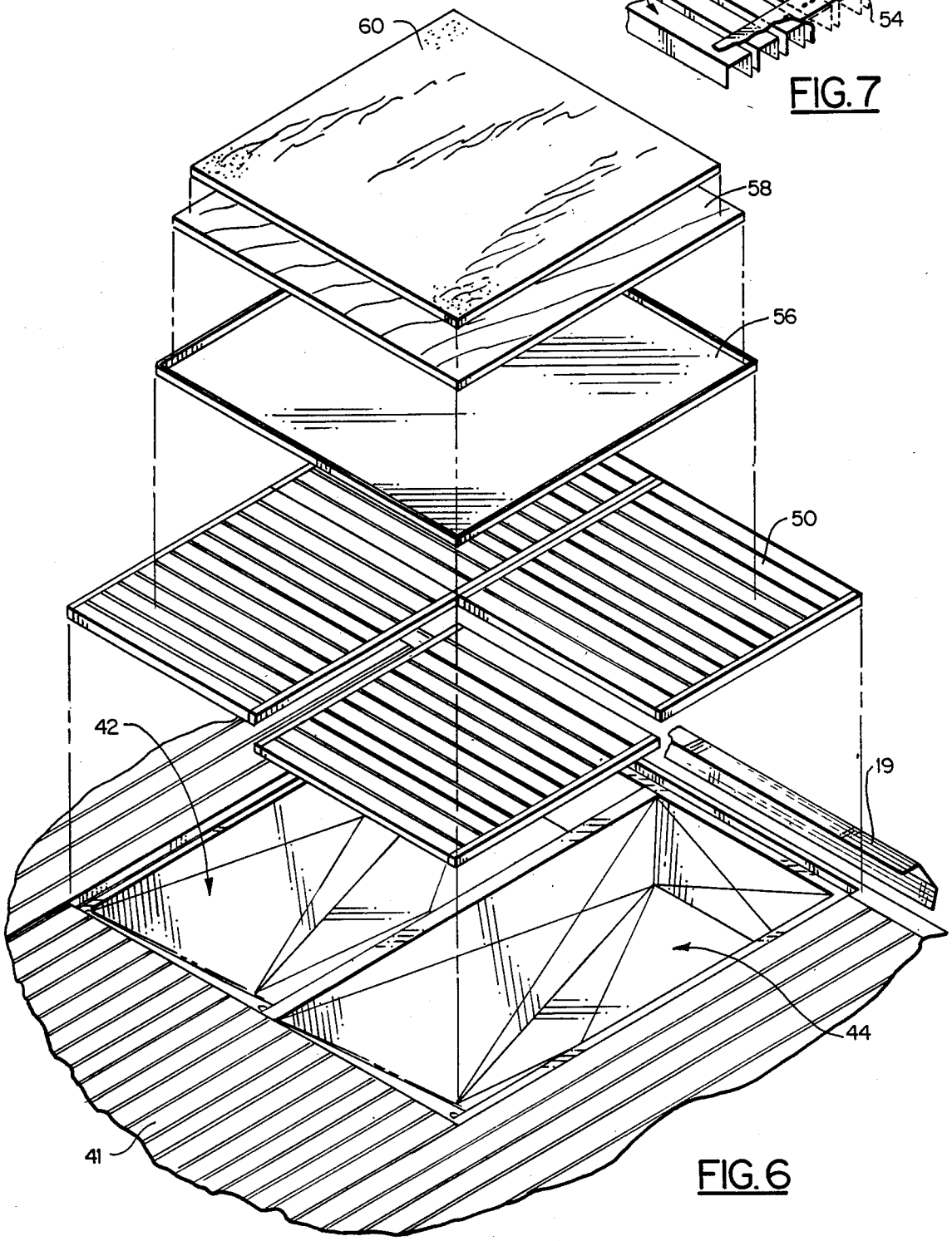
FIG. 6 is a fragmentary, exploded, perspective view of a portion of the floor of the housing, showing the plenum from which warmed air rises.
Figure 8:
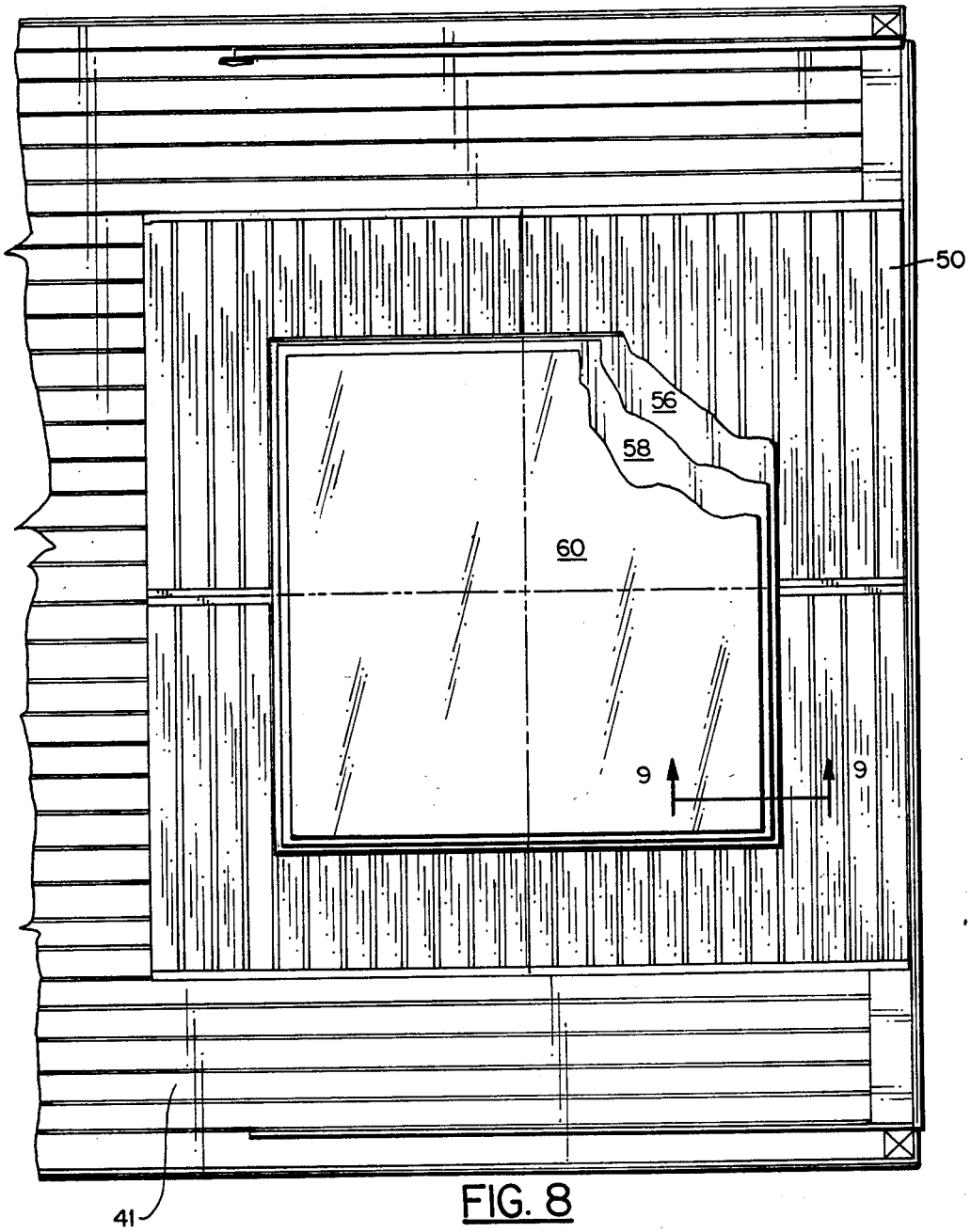
FIG. 8 is a top plan view of the floor of the housing showing the decking mats, partly broken away.
Figure 9:
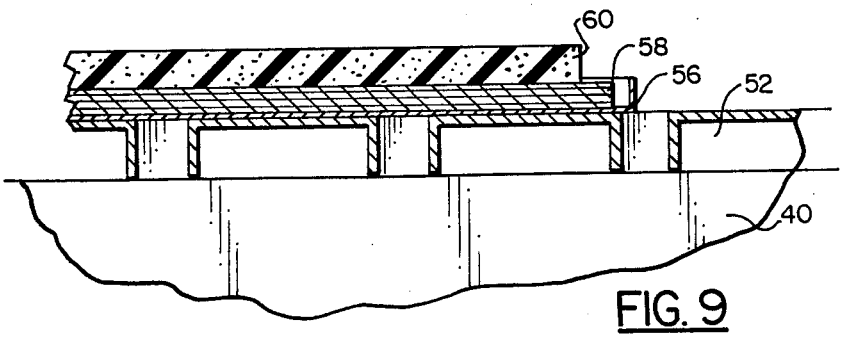
FIG. 9 is a fragmentary, enlarged view of a portion of the floor of FIG. 8, in section taken generally along the line 8—8.

In the preferred embodiment, a trio of layers are affixed to a central region of the grating 50 for ball placing purposes, as shown in FIGS. 6, 8, and 9. The bottom layer 56 is preferably steel, the middle layer 58 plywood and top layer 60 a foam pad or like low density material, or a section of conventional, artificial turf. The central placing of the layers will cause the warm air to rise around the perimeter of the layers where the golfer will stand upon striking the ball.

As can be seen in FIGS. 1–4, the housing 10 is configured such that the roof 16 slopes substantially downward from the front wall 12, toward the back wall 18 whereby warm air rising from the open grating 50 will tend to collect in the area between the inside surface of roof 16 and front wall 12. In FIG. 4, housing 10 is seen to include recirculation means attached to the inside surface of roof 16 which force warmed air from the area between the inside surface of roof 16 and front wall 12, through elongated tube section 17, including a fan (not shown), back toward the space occupied by the golfer.

FIGS. 4 and 6 are seen to include elongated drip guard 19 attached to the front ledge of the floor 41. Drip guard 19 will substantially prevent entry of falling rain or snow into housing 10 under doors 15.

What is claimed is:

1. A stall-type enclosure for use by a golfer at a driving range during inclement weather, said enclosure comprising:

(a) a roof and side, back and front walls, said front wall having an opening through which a ball may be driven by a golfer standing within said enclosure and executing a full swing;

(b) a floor within said enclosure elevated above ground level to provide an enclosed space beneath said flooring;

(c) an air plenum positioned within said enclosed space, said plenum having an open top of first, predetermined outline;

(d) means providing heated air to said plenum;

(e) a predetermined section of said flooring comprising an open grating, at least a portion of which is positioned directly above said open top of said plenum, in fully covering relation thereto; and (f) a mat adapted for supporting said golfer and ball, said mat being positioned upon said portion of said open grating and having a second, predetermined outline, smaller than said first outline, whereby said heated air may rise through said open grating in an area at least partially surrounding said mat.

2. The stall-type enclosure of claim 1 wherein said opening has a lower edge substantially in the plane of said flooring, and thereby above ground level.

3. The stall-type enclosure of claim 2 wherein said first and second predetermined outlines are rectangular and both the length and width of said first outline are greater than the length and width of said second outline.

4. The stall-type enclosure of claim 3 wherein said mat is positioned with its periphery entirely within said first predetermined outline, whereby said heated air may rise through said open grating in an area entirely surrounding said mat.

5. The stall-type enclosure of claim 4 and further including an elongated drip guard extending substantially entirely across said lower edge of said opening and downwardly therefrom on said front wall.

* * * * *